US012448668B2

(12) United States Patent
Guo et al.

(10) Patent No.: US 12,448,668 B2
(45) Date of Patent: Oct. 21, 2025

(54) ALUMINUM ALLOY AND APPLICATION THEREOF

(71) Applicants: BYD AUTO INDUSTRY COMPANY LIMITED, Guangdong (CN); HUAWEI TECHNOLOGIES CO., LTD., Guangdong (CN)

(72) Inventors: Qiang Guo, Shenzhen (CN); Mengde Wang, Shenzhen (CN); Tao Yang, Shenzhen (CN); Rong Wang, Shenzhen (CN); Wei An, Shenzhen (CN); Jingsong Fu, Shenzhen (CN)

(73) Assignees: BYD AUTO INDUSTRY COMPANY LIMITED, Shenzhen (CN); HUAWEI TECHNOLOGIES CO., LTD., Shenzhen (CN)

( * ) Notice: Subject to any disclaimer, the term of this patent is extended or adjusted under 35 U.S.C. 154(b) by 579 days.

(21) Appl. No.: 17/787,536

(22) PCT Filed: Mar. 24, 2020

(86) PCT No.: PCT/CN2020/080947
§ 371 (c)(1),
(2) Date: Jun. 20, 2022

(87) PCT Pub. No.: WO2021/120437
PCT Pub. Date: Jun. 24, 2021

(65) Prior Publication Data

US 2022/0380869 A1 Dec. 1, 2022

(30) Foreign Application Priority Data

Dec. 20, 2019 (CN) ..... 201911327356.5

(51) Int. Cl.
*C22C 21/02* (2006.01)

(52) U.S. Cl.
CPC ..... *C22C 21/02* (2013.01)

(58) Field of Classification Search
CPC ..... C22C 21/02; C22C 1/026; C22C 21/04; B22D 21/04
See application file for complete search history.

(56) References Cited

U.S. PATENT DOCUMENTS 6,824,737 B2 * 11/2004 Koch ..... C22C 21/04 420/549

FOREIGN PATENT DOCUMENTS

CN 1410572 A 4/2003
CN 1537961 A 10/2004
(Continued)

OTHER PUBLICATIONS

Li Qingwen et.al. [CN103031473A] (machine translation) (Year: 2013).*

(Continued)

*Primary Examiner* — Sally A Merkling
*Assistant Examiner* — Nazmun Nahar Shams
(74) *Attorney, Agent, or Firm* — Calfee, Halter & Griswold LLP

(57) ABSTRACT

An aluminum alloy and applications thereof are disclosed. Based on the total weight of the aluminum alloy, the aluminum alloy includes: 8-11% of Si, 2-4% of Cu, 0.6-4% of Zn, 0.65-1.1% of Mn, 0.35-0.65% of Mg, 0.001-0.05% of Cr, 0.01-0.03% of Sr, 0.08-0.12% of Ti, 0.008-0.02% of B, 0.1-0.3% of Fe, 0.01-0.02% of Ga, 0.008-0.015% of Sn, and the balance of Al and less than 0.1% of other elements.

17 Claims, 8 Drawing Sheets

(56) References Cited

FOREIGN PATENT DOCUMENTS

| | | | |
|---|---|---|---|
| CN | 1737176 | A | 2/2006 |
| CN | 102312135 | A | 1/2012 |
| CN | 102676885 | A | 9/2012 |
| CN | 103031473 | A | 4/2013 |
| CN | 104878250 | A | 9/2015 |
| CN | 105039798 | A | 11/2015 |
| CN | 105088033 | A | 11/2015 |
| CN | 106119626 | A | 11/2016 |
| CN | 106367638 | A | 2/2017 |
| CN | 106811630 | A | 6/2017 |
| CN | 108624788 | A | 10/2018 |
| CN | 109022940 | A | 12/2018 |
| CN | 109457146 | A | 3/2019 |
| CN | 110184510 | A | 8/2019 |
| CN | 110343918 | A | 10/2019 |
| CN | 110453122 | A | 11/2019 |
| CN | 110527871 | A | 12/2019 |
| DE | 102009036056 | A1 | 2/2011 |
| EP | 1645647 | B1 | 12/2007 |
| MX | 2004007834 | A1 | 2/2006 |

OTHER PUBLICATIONS

Zhang Faliang, et.al. [WO2016015488A1] (machine translation) (Year: 2016).*

Gong Qing, et. al. [WO2017107511A1] (machine translation) (Year: 2017).*

Hatch J E Ed—Hatch J E: "Aluminium, Properties and Physical Metallurgy, passage" , Jan. 1, 1987 (Jan. 1, 1987), Aluminum.

English Translation of International Search Report from PCT/CN2020/080947dated Sep. 23, 2020 (2 pages).

* cited by examiner

ALUMINUM ALLOY AND APPLICATION THEREOF

CROSS-REFERENCE TO RELATED APPLICATIONS

The present disclosure is the U.S. National Stage of the PCT International Application of PCT/CN2020/080947, filed on Mar. 24, 2020, which claims priority to and benefits of Chinese Patent Application No. 201911327356.5, entitled "ALUMINUM ALLOY AND APPLICATIONS THEREOF" filed with the China National Intellectual Property Administration on Dec. 20, 2019. The entire content of the above-referenced applications is are incorporated herein by reference.

FIELD

The present disclosure relates to the technical field of alloy materials, and more specifically, to an aluminum alloy and applications thereof.

BACKGROUND

Die casting is a precision casting process that is characterized by forcing molten metal under high pressure into a metal mold cavity with a complex shape. Die castings are characterized by a very small dimensional tolerance and a high surface precision.

Die casting of aluminum alloys has high requirements on their mechanical properties, such as yield strength, elongation at break, and melt fluidity. During die casting, existing Al—Si alloy materials, such as ADC12, are highly dependent on the accuracy of control conditions for the formation process and are greatly affected by slight variation in process parameters, mainly because it is difficult to give consideration to all the yield strength, tensile strength, elongation, etc. of the Al—Si alloy materials. In different types of Al—Si alloy materials, usually the elongation will decrease correspondingly while the yield strength and tensile strength increase, and the yield strength will decrease correspondingly while the elongation increases. The yield strength, tensile strength, elongation, etc. are all factors that greatly affect the properties of die-casting materials.

SUMMARY

To resolve the problem that it is difficult to give consideration to various property requirements for existing aluminum alloys in die casting, the present disclosure provides an aluminum alloy and applications thereof.

The technical solutions adopted by the present disclosure to resolve the foregoing technical problem are as follows:

According to an aspect, the present disclosure provides an aluminum alloy. Based on the total weight of the aluminum alloy, the aluminum alloy includes: 8-11% of Si, 2-4% of Cu, 0.6-4% of Zn, 0.65-1.1% of Mn, 0.35-0.65% of Mg, 0.001-0.05% of Cr, 0.01-0.03% of Sr, 0.08-0.12% of Ti, 0.008-0.02% of B, 0.1-0.3% of Fe, 0.01-0.02% of Ga, 0.008-0.015% of Sn, and the balance of Al and less than 0.1% of other elements.

Optionally, based on the total weight of the aluminum alloy, the aluminum alloy includes: 9-11% of Si, 2-3% of Cu, 0.6-2% of Zn, 0.65-0.8% of Mn, 0.35-0.65% of Mg, 0.001-0.02% of Cr, 0.01-0.02% of Sr, 0.08-0.1% of Ti, 0.008-0.01% of B, 0.1-0.3% of Fe, 0.01-0.02% of Ga, 0.008-0.015% of Sn, and the balance of Al and less than 0.1% of other elements, each of the other elements being less than 0.01%.

Optionally, based on the total weight of the aluminum alloy, the content of P in the aluminum alloy is less than 0.001%.

Optionally, in the aluminum alloy, the weight ratio of Ti to B is (4-10):1.

Optionally, in the aluminum alloy, the content of Ga in percentage by weight is greater than the content of B in percentage by weight.

Optionally, in the aluminum alloy, the weight ratio of Mn to Mg is (1-2.5):1.

Optionally, in the aluminum alloy, the weight ratio of Ga to Sn is (0.8-1.5):1.

Optionally, in the aluminum alloy, Zn, Mn, and Mg satisfy the following relationship in weight:

$$-3.979+4.9Mn+3.991Mg \leq Zn \leq 8.598-5.047Mn-3.762Mg.$$

Optionally, for the aluminum alloy, the yield strength of the aluminum alloy is not less than 230 MPa, the tensile strength of the aluminum alloy is not less than 380 MPa, the elongation of the aluminum alloy is not less than 3%, and the thermal conductivity of the aluminum alloy is not less than 120 W/(k·m).

According to another aspect, the present disclosure provides applications of the foregoing aluminum alloy in die-casting materials.

The aluminum alloy provided in the present disclosure breaks through the optimal performance of medium strength and high toughness of existing Al—Si alloys by adjusting proportions of all elements in the aluminum alloy. Usually in Al—Si alloys, when the strength of the alloys is higher than 230 MPa and the elongation at break of the alloys is less than 3%, there is a good formation and no cracking of the alloys. In addition to a high thermal conductivity, the aluminum alloy provided in the present disclosure also ensures the increase of yield strength, tensile strength, and elongation at break. High elongation at break allowing the material to show excellent toughness in die-cast products, resolving the problem that it is difficult for existing Al—Si alloys to give consideration to all the yield strength, tensile strength, and elongation, in addition, the aluminum alloy material has low process requirements, and has good process adaptability in die casting.

Additional aspects and advantages of the present disclosure will be given in the following description, some of which will become apparent from the following description or may be learned from practices of the present disclosure.

BRIEF DESCRIPTION OF THE DRAWINGS

The foregoing additional aspects and advantages of the present disclosure will become apparent and comprehensible from the following descriptions of the embodiments with reference to the accompanying drawings.

DETAILED DESCRIPTION

Figure 1:
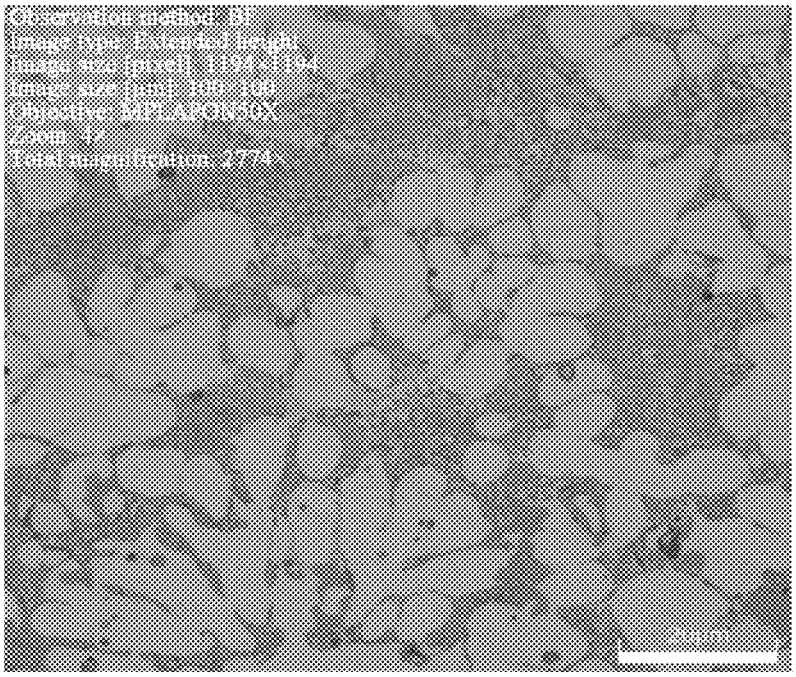
FIG. 1 is a metallographic image of an aluminum alloy provided in Example 1 of the present disclosure.

The endpoints and any values of the ranges disclosed herein are not limited to the precise range or value, and such ranges or values should be understood to include values that are close to the ranges or values. For numerical ranges, the endpoint values of the various ranges, the endpoint values of the various ranges and the individual point values, and the individual point values may be combined with one another to yield one or more new numerical ranges, and these numerical ranges should be considered as specifically disclosed herein.

To make the technical problems to be resolved by the present disclosure, technical solutions, and beneficial effects more comprehensible, the following further describes the present disclosure in detail with reference to the embodiments. It should be understood that the embodiments described herein are merely used for explaining the present disclosure instead of limiting the present disclosure.

An embodiment of the present disclosure provides an aluminum alloy. Based on the total weight of the aluminum alloy, the aluminum alloy includes: 8-11% of Si, 2-4% of Cu, 0.6-4% of Zn, 0.65-1.1% of Mn, 0.35-0.65% of Mg, 0.001-0.05% of Cr, 0.01-0.03% of Sr, 0.08-0.12% of Ti, 0.008-0.02% of B, 0.1-0.3% of Fe, 0.01-0.02% of Ga, 0.008-0.015% of Sn, and the balance of Al and less than 0.1% of other elements.

The aluminum alloy provided in the present disclosure breaks through the optimal performance of medium strength and high toughness of existing Al—Si alloys by adjusting proportions of all elements in the aluminum alloy. In addition to a high thermal conductivity, the aluminum alloy provided also ensures the increase of yield strength and elongation at break, so that the material shows excellent toughness in die-cast products. In addition, the aluminum alloy material has low process requirements, and has good process adaptability in die casting.

In some embodiments, based on the total weight of the aluminum alloy, the aluminum alloy includes: 9-11% of Si, 2-3% of Cu, 0.6-2% of Zn, 0.65-0.8% of Mn, 0.35-0.65% of Mg, 0.001-0.02% of Cr, 0.01-0.02% of Sr, 0.08-0.1% of Ti, 0.008-0.01% of B, 0.1-0.3% of Fe, 0.01-0.02% of Ga, 0.008-0.015% of Sn, and the balance of Al and less than 0.1% of other elements, each of the other elements being less than 0.01%.

In some embodiments, the content of Si is 9%, 9.5%, 10%, 10.5%, or 11%, the content of Cu is 2%, 2.2%, 2.6%, 2.8%, or 3%, the content of Zn is 0.6%, 0.9%, 1.1%, 1.5%, 1.8%, or 2%, the content of Mn is 0.65%, 0.7%, 0.73%, 0.78%, or 0.8%, the content of Mg is 0.35%, 0.42%, 0.48%, 0.53%, 0.59%, or 0.65%, the content of Cr is 0.001%, 0.005%, 0.01%, 0.013%, 0.017%, or 0.02%, the content of Sr is 0.01%, 0.014%, 0.018%, or 0.02%, the content of Ti is 0.08%, 0.09%, or 0.1%, the content of B is 0.008%, 0.009%, or 0.01%, the content of Fe is 0.1%, 0.16%, 0.25%, or 0.3%, the content of Ga is 0.01%, 0.014%, or 0.02%, and the content of Sn is 0.008%, 0.01%, 0.013%, or 0.015%.

The content of Si is 8-11%, most of Si forms eutectic Si. Without sacrificing the thermal conductivity of the material, on the one hand, the addition of Si ensures the fluidity of the material and improves the formation of the material; on the other hand, modified by Sr and other elements, Si forms extremely fine (0.01-1 μm) fibrous eutectic Si, which greatly increases the grain boundary strength of the material, thereby increasing the overall strength (yield strength and tensile strength) of the material. Si may form $Mg_2Si$ phase and $Al_{12}Fe_3Si$ phase with Mg and Fe respectively, thereby increasing the overall strength (yield strength and tensile strength) of the material.

Cu and Al form a solid solution phase. In addition, precipitated $Al_2Cu_2$ is dispersed on the grain boundary as a strengthening phase, which may increase the strength of the material, but with an excessive amount, it will damage the toughness of the material and reduce the elongation at break.

Zn may be dissolved into the α-aluminum alloy matrix, greatly increasing the overall strength of the alloy. Also, Zn and Cu form a CuZn phase, which ensures good plasticity with high strength. In addition, Zn and Mg form a $MgZn_2$ strengthening phase uniformly dispersed on the grain boundary, increasing grain boundary energy, thereby increasing the yield strength and toughness of the material.

Mn and Cr may be dissolved into the aluminum alloy matrix to strengthen the performance of the matrix and inhibit the grain growth of primary Si and α-A1, so that the primary Si is dispersed among grains for dispersion strengthening, thereby increasing the strength and toughness of the material. For Mn, most of Mn segregates to the grain boundary and combines with Fe to form a needle-like AlFeMnSi phase, which may increase the overall strength of the material. When the content of Mn is too high, a large number of needle-like structures will cause the splitting of the matrix and reduce the toughness of the material.

Ti and B may form TiB agglomerates. Through the induction of Ti and Ga, the agglomerates combine with Mg and Fe at the original grain boundary to form a large number of spherical phases dispersed among the grains, so that primary Si may uniformly distribute into α-A1, which greatly inhibits the growth of α-A1 (the particle size is reduced by one-third), thereby increasing the strength and toughness of the material.

The mechanical properties, thermal conductivity, and elongation of the aluminum alloy are the result of the combined effect of the foregoing elements. Any element that deviates from the scope provided by the present disclosure deviates from the disclosure intent of the present disclosure, resulting in a reduction in mechanical properties, thermal conductivity, or elongation of the aluminum alloy, thereby detrimental to the applications of the aluminum alloy as a die-casting material.

In some embodiments, based on the total weight of the aluminum alloy, the content of P in the aluminum alloy is less than 0.001%.

It was found through further experiments that an excessively high content of P in the aluminum alloy will cause a reduction in elongation of the aluminum alloy, which is not conducive to die casting of the aluminum alloy.

In some embodiments, in the aluminum alloy, the weight ratio of Ti to B is (4-10):1. For example, the weight ratio of Ti to B is 4:1, 4.1:1, 9.9:1, or 10:1. It was found that Ti and B in this ratio ensure the high strength and thermal conductivity of the material. The reason is that Ti within this content range is uniformly distributed around the eutectic Si, increasing the strength, and the addition of B in this ratio ensures the high strength with good thermal conductivity.

In some embodiments, in the aluminum alloy, the content of Ga in percentage by weight is greater than the content of B in percentage by weight. It was found that, if the content of B in percentage by weight is greater than that of Ga, the excess B will surround Ga, hindering Ga grain refinement, so that Ga cannot uniformly distributed between the eutectic Si and α-solid solution, thereby reducing the toughness and thermal conductivity of the material.

In some embodiments, in the aluminum alloy, the weight ratio of Mn to Mg is (1-2.5):1. For example, the weight ratio of Mn to Mg is 1:1, 1.1:1, 2.4:1, or 2.5:1. It was found that the toughness of the aluminum alloy material in this ratio reaches the optimal state. When greater than this ratio, the excess Mn cannot be solutionized into the material and exists in the form of impurities, resulting in serious inclusions and black hole defects in the material. When less than this ratio, the effect of Mg increases to make the material more obvious in performance after aging and more sensitive to temperature, so that the elongation decreases rapidly and the toughness is insufficient for the material after heat treatment.

In some embodiments, in the aluminum alloy, the weight ratio of Ga to Sn is (0.8-1.5):1. For example, the weight ratio of Ga to Sn is 0.8:1, 0.9:1, 1.4:1, or 1.5:1. It was found that the addition of Ga may increase the toughness and strength of the material; Sn and Mg may form an intermediate alloy phase $Mg_2Sn$, effectively inhibiting grain growth and increasing the toughness and strength of the material; and the ratio of Ga to Sn meets the foregoing requirements, which ensures the strength of the material without damaging the toughness of the material. With a ratio of Ga to Sn greater than this ratio, the Mg—Sn phase gradually decreases, even clusters together, and is still distributed at the grain boundary of the aluminum alloy in a linear shape instead of an original dendritic shape, and the formation of Ga-rich phase will capture Mg atoms from $Mg_2Sn$, so that the Mg—Sn phase is reduced in its relative content, and gradually clusters to form linear-shape distribution, which will severely split the matrix, resulting in reduced toughness and reduced elongation at break of the material. With a ratio of Ga to Sn less than this ratio, the $Mg_2Sn$ phase will form a large amount of network and fishbone-like distribution, which is a brittle phase, reducing the toughness of the material.

In some embodiments, in the aluminum alloy, Zn, Mn, and Mg satisfy the following relationship in weight:

$-3.979+4.9\ Mn+3.991\ Mg \leq Zn \leq 8.598-5.047\ Mn-3.762\ Mg$. It was found that, when all the three elements meet this condition, the material may ensure good toughness with high strength.

In some embodiments, for the aluminum alloy, the yield strength of the aluminum alloy is not less than 230 MPa, the tensile strength of the aluminum alloy is not less than 380 MPa, the elongation of the aluminum alloy is not less than 3%, and the thermal conductivity of the aluminum alloy is not less than 120 W/(km).

In some embodiments, the yield strength of the aluminum alloy is 230-260 MPa, the tensile strength of the aluminum alloy is 380-410 MPa, the elongation of the aluminum alloy is 4-7%, and the thermal conductivity of the aluminum alloy is 130-150 W/(km).

Another embodiment of the present disclosure provides applications of the foregoing aluminum alloy in die-casting materials.

The aluminum alloy has high toughness and good elongation without sacrificing the strength and fluidity of the material. The material has low process requirements and is suitable for applications as die-casting materials.

The die-cast aluminum alloy has high thermal conductivity and high toughness. The excellent fluidity and formability of the material combined with the high toughness contribute to the maximum breaking force of three-point bending during die casting of mobile phone mid plates.

The present disclosure is described with reference to the following examples. It should be noted that these examples are merely illustrative and are not intended to limit the present disclosure in any way.

TABLE 1

| | Si | Cu | Zn | Mn | Mg | Cr | Sr | Ti | B | Fe | Ga | Sn | P |
|---|---|---|---|---|---|---|---|---|---|---|---|---|---|
| Example 1 | 10 | 2.5 | 1.5 | 0.7 | 0.5 | 0.015 | 0.015 | 0.09 | 0.01 | 0.2 | 0.013 | 0.013 | 0 |
| Example 2 | 9.5 | 2.5 | 1.5 | 0.7 | 0.5 | 0.015 | 0.015 | 0.09 | 0.01 | 0.2 | 0.013 | 0.013 | 0 |
| Example 3 | 10.5 | 2.5 | 1.5 | 0.7 | 0.5 | 0.015 | 0.015 | 0.09 | 0.01 | 0.2 | 0.013 | 0.013 | 0 |
| Example 4 | 10 | 2.1 | 1.5 | 0.7 | 0.5 | 0.015 | 0.015 | 0.09 | 0.01 | 0.2 | 0.013 | 0.013 | 0 |
| Example 5 | 10 | 2.8 | 1.5 | 0.7 | 0.5 | 0.015 | 0.015 | 0.09 | 0.01 | 0.2 | 0.013 | 0.013 | 0 |
| Example 6 | 10 | 2.5 | 0.7 | 0.7 | 0.5 | 0.015 | 0.015 | 0.09 | 0.01 | 0.2 | 0.013 | 0.013 | 0 |
| Example 7 | 10 | 2.5 | 2 | 0.7 | 0.5 | 0.015 | 0.015 | 0.09 | 0.01 | 0.2 | 0.013 | 0.013 | 0 |
| Example 8 | 10 | 2.5 | 1.5 | 0.65 | 0.5 | 0.015 | 0.015 | 0.09 | 0.01 | 0.2 | 0.013 | 0.013 | 0 |
| Example 9 | 10 | 2.5 | 1.5 | 0.8 | 0.5 | 0.015 | 0.015 | 0.09 | 0.01 | 0.2 | 0.013 | 0.013 | 0 |
| Example 10 | 10 | 2.5 | 1.5 | 0.7 | 0.35 | 0.015 | 0.015 | 0.09 | 0.01 | 0.2 | 0.013 | 0.013 | 0 |
| Example 11 | 10 | 2.5 | 1.5 | 0.7 | 0.65 | 0.015 | 0.015 | 0.09 | 0.01 | 0.2 | 0.013 | 0.013 | 0 |
| Example 12 | 10 | 2.5 | 1.5 | 0.7 | 0.5 | 0.01 | 0.015 | 0.09 | 0.01 | 0.2 | 0.013 | 0.013 | 0 |
| Example 13 | 10 | 2.5 | 1.5 | 0.7 | 0.5 | 0.02 | 0.015 | 0.09 | 0.01 | 0.2 | 0.013 | 0.013 | 0 |
| Example 14 | 10 | 2.5 | 1.5 | 0.7 | 0.5 | 0.015 | 0.01 | 0.09 | 0.01 | 0.2 | 0.013 | 0.013 | 0 |
| Example 15 | 10 | 2.5 | 1.5 | 0.7 | 0.5 | 0.015 | 0.02 | 0.09 | 0.011 | 0.2 | 0.013 | 0.013 | 0 |
| Example 16 | 10 | 2.5 | 1.5 | 0.7 | 0.5 | 0.015 | 0.015 | 0.08 | 0.011 | 0.2 | 0.013 | 0.013 | 0 |
| Example 17 | 10 | 2.5 | 1.5 | 0.7 | 0.5 | 0.015 | 0.015 | 0.1 | 0.011 | 0.2 | 0.013 | 0.013 | 0 |
| Example 18 | 10 | 2.5 | 1.5 | 0.7 | 0.5 | 0.015 | 0.015 | 0.09 | 0.009 | 0.2 | 0.013 | 0.013 | 0 |
| Example 19 | 10 | 2.5 | 1.5 | 0.7 | 0.5 | 0.015 | 0.015 | 0.09 | 0.012 | 0.2 | 0.013 | 0.013 | 0 |
| Example 20 | 10 | 2.5 | 1.5 | 0.7 | 0.5 | 0.015 | 0.015 | 0.09 | 0.011 | 0.1 | 0.013 | 0.013 | 0 |
| Example 21 | 10 | 2.5 | 1.5 | 0.7 | 0.5 | 0.015 | 0.015 | 0.09 | 0.011 | 0.3 | 0.013 | 0.013 | 0 |
| Example 22 | 10 | 2.5 | 1.5 | 0.7 | 0.5 | 0.015 | 0.015 | 0.09 | 0.011 | 0.2 | 0.012 | 0.013 | 0 |
| Example 23 | 10 | 2.5 | 1.5 | 0.7 | 0.5 | 0.015 | 0.015 | 0.09 | 0.011 | 0.2 | 0.015 | 0.013 | 0 |
| Example 24 | 10 | 2.5 | 1.5 | 0.7 | 0.5 | 0.015 | 0.015 | 0.09 | 0.011 | 0.2 | 0.013 | 0.011 | 0 |
| Example 25 | 10 | 2.5 | 1.5 | 0.7 | 0.5 | 0.015 | 0.015 | 0.09 | 0.011 | 0.2 | 0.013 | 0.015 | 0 |
| Example 26 | 8 | 2.5 | 1.5 | 0.7 | 0.5 | 0.015 | 0.015 | 0.09 | 0.011 | 0.2 | 0.013 | 0.013 | 0 |
| Example 27 | 10 | 4 | 1.5 | 0.7 | 0.5 | 0.015 | 0.015 | 0.09 | 0.011 | 0.2 | 0.013 | 0.013 | 0 |
| Example 28 | 10 | 2.5 | 3 | 0.7 | 0.5 | 0.015 | 0.015 | 0.09 | 0.011 | 0.2 | 0.013 | 0.013 | 0 |
| Example 29 | 10 | 2.5 | 1.5 | 1.1 | 0.5 | 0.015 | 0.015 | 0.09 | 0.011 | 0.2 | 0.013 | 0.013 | 0 |

TABLE 1-continued

| | Si | Cu | Zn | Mn | Mg | Cr | Sr | Ti | B | Fe | Ga | Sn | P |
|---|---|---|---|---|---|---|---|---|---|---|---|---|---|
| Example 30 | 10 | 2.5 | 1.5 | 0.7 | 0.5 | 0.04 | 0.015 | 0.09 | 0.011 | 0.2 | 0.013 | 0.013 | 0 |
| Example 31 | 10 | 2.5 | 1.5 | 0.7 | 0.5 | 0.015 | 0.03 | 0.09 | 0.011 | 0.2 | 0.013 | 0.013 | 0 |
| Example 32 | 10 | 2.5 | 1.5 | 0.7 | 0.5 | 0.015 | 0.015 | 0.11 | 0.011 | 0.2 | 0.013 | 0.013 | 0 |
| Example 33 | 10 | 2.5 | 1.5 | 0.7 | 0.5 | 0.015 | 0.015 | 0.09 | 0.016 | 0.2 | 0.017 | 0.013 | 0 |
| Example 34 | 10 | 2.5 | 1.5 | 0.7 | 0.5 | 0.015 | 0.015 | 0.09 | 0.011 | 0.2 | 0.013 | 0.013 | 0.0009 |
| Example 35 | 10 | 2.5 | 1.5 | 0.7 | 0.5 | 0.015 | 0.015 | 0.09 | 0.011 | 0.2 | 0.013 | 0.013 | 0.01 |
| Example 36 | 10 | 2.5 | 1.5 | 0.7 | 0.5 | 0.015 | 0.015 | 0.12 | 0.011 | 0.2 | 0.013 | 0.013 | 0 |
| Example 37 | 10 | 2.5 | 1.5 | 0.7 | 0.5 | 0.015 | 0.015 | 0.09 | 0.015 | 0.2 | 0.013 | 0.013 | 0 |
| Example 38 | 10 | 2.5 | 1.5 | 1.1 | 0.35 | 0.015 | 0.015 | 0.09 | 0.011 | 0.2 | 0.013 | 0.013 | 0 |
| Example 39 | 10 | 2.5 | 1.5 | 0.7 | 0.5 | 0.015 | 0.015 | 0.09 | 0.011 | 0.2 | 0.01 | 0.015 | 0 |
| Example 40 | 10 | 2.5 | 1.5 | 0.7 | 0.5 | 0.015 | 0.015 | 0.09 | 0.011 | 0.2 | 0.02 | 0.01 | 0 |
| Example 41 | 10 | 2.5 | 1 | 0.7 | 0.5 | 0.015 | 0.015 | 0.09 | 0.01 | 0.2 | 0.013 | 0.013 | 0 |
| Comparative Example 1 | 10 | 2.5 | 1.5 | 0.7 | 0.5 | 0.015 | 0.015 | 0.09 | 0.011 | 0.2 | 0.013 | 0.013 | 0.15 |
| Comparative Example 2 | 6 | 2.5 | 1.5 | 0.7 | 0.5 | 0.015 | 0.015 | 0.09 | 0.011 | 0.2 | 0.013 | 0.013 | 0 |
| Comparative Example 3 | 14 | 2.5 | 1.5 | 0.7 | 0.5 | 0.015 | 0.015 | 0.09 | 0.011 | 0.2 | 0.013 | 0.013 | 0 |
| Comparative Example 4 | 10 | 1 | 1.5 | 0.7 | 0.5 | 0.015 | 0.015 | 0.09 | 0.011 | 0.2 | 0.013 | 0.013 | 0 |
| Comparative Example 5 | 10 | 6 | 1.5 | 0.7 | 0.5 | 0.015 | 0.015 | 0.09 | 0.011 | 0.2 | 0.013 | 0.013 | 0 |
| Comparative Example 6 | 10 | 2.5 | 0.1 | 0.7 | 0.5 | 0.015 | 0.015 | 0.09 | 0.011 | 0.2 | 0.013 | 0.013 | 0 |
| Comparative Example 7 | 10 | 2.5 | 7 | 0.7 | 0.5 | 0.015 | 0.015 | 0.09 | 0.011 | 0.2 | 0.013 | 0.013 | 0 |
| Comparative Example 8 | 10 | 2.5 | 1.5 | 0.3 | 0.5 | 0.015 | 0.015 | 0.09 | 0.011 | 0.2 | 0.013 | 0.013 | 0 |
| Comparative Example 9 | 10 | 2.5 | 1.5 | 1.5 | 0.5 | 0.015 | 0.015 | 0.09 | 0.011 | 0.2 | 0.013 | 0.013 | 0 |
| Comparative Example 10 | 10 | 2.5 | 1.5 | 0.7 | 0.1 | 0.015 | 0.015 | 0.09 | 0.011 | 0.2 | 0.013 | 0.013 | 0 |
| Comparative Example 11 | 10 | 2.5 | 1.5 | 0.7 | 0.5 | 0 | 0.015 | 0.09 | 0.011 | 0.2 | 0.013 | 0.013 | 0 |
| Comparative Example 12 | 10 | 2.5 | 1.5 | 0.7 | 0.5 | 0.1 | 0.015 | 0.09 | 0.011 | 0.2 | 0.013 | 0.013 | 0 |
| Comparative Example 13 | 10 | 2.5 | 1.5 | 0.7 | 0.5 | 0.015 | 0.005 | 0.09 | 0.011 | 0.2 | 0.013 | 0.013 | 0 |
| Comparative Example 14 | 10 | 2.5 | 1.5 | 0.7 | 0.5 | 0.015 | 0.1 | 0.09 | 0.011 | 0.2 | 0.013 | 0.013 | 0 |
| Comparative Example 15 | 10 | 2.5 | 1.5 | 0.7 | 0.5 | 0.015 | 0.015 | 0.01 | 0.011 | 0.2 | 0.013 | 0.013 | 0 |
| Comparative Example 16 | 10 | 2.5 | 1.5 | 0.7 | 0.5 | 0.015 | 0.015 | 0.6 | 0.011 | 0.2 | 0.013 | 0.013 | 0 |
| Comparative Example 17 | 10 | 2.5 | 1.5 | 0.7 | 0.5 | 0.015 | 0.015 | 0.09 | 0 | 0.2 | 0.013 | 0.013 | 0 |
| Comparative Example 18 | 10 | 2.5 | 1.5 | 0.7 | 0.5 | 0.015 | 0.015 | 0.09 | 0.09 | 0.2 | 0.013 | 0.013 | 0 |
| Comparative Example 19 | 10 | 2.5 | 1.5 | 0.7 | 0.5 | 0.015 | 0.015 | 0.09 | 0.011 | 0.8 | 0.013 | 0.013 | 0 |
| Comparative Example 20 | 10 | 2.5 | 1.5 | 0.7 | 0.5 | 0.015 | 0.015 | 0.09 | 0.011 | 0.2 | 0.001 | 0.013 | 0 |
| Comparative Example 21 | 10 | 2.5 | 1.5 | 0.7 | 0.5 | 0.015 | 0.015 | 0.09 | 0.011 | 0.2 | 0.08 | 0.013 | 0 |
| Comparative Example 22 | 10 | 2.5 | 1.5 | 0.7 | 0.5 | 0.015 | 0.015 | 0.09 | 0.011 | 0.2 | 0.013 | 0 | 0 |
| Comparative Example 23 | 10 | 2.5 | 1.5 | 0.7 | 0.5 | 0.015 | 0.015 | 0.09 | 0.011 | 0.2 | 0.013 | 0.07 | 0 |

Note:
Each composition in Table 1 is in percentage by weight, and the total weight of inevitable impurity elements is less than 0.1%.

Example 1

This example is used to describe the aluminum alloy and the preparation method thereof in the present disclosure, including the following steps:

As shown in Table 1, the components of the aluminum alloy in percentage by weight include: 10% of Si, 2.5% of Cu, 1.5% of Zn, 0.7% of Mn, 0.5% of Mg, 0.015% of Cr, 0.015% of Sr, 0.09% of Ti, 0.01% of B, 0.2% of Fe, 0.013% of Ga, and 0.013% of Sn. The required weight of intermediate alloys or metal elements was calculated based on the weight of the foregoing components of the aluminum alloy, and the intermediate alloys or metal elements were melted and mixed into an aluminum alloy ingot. The aluminum alloy ingot was naturally aged for 7 d to obtain an aluminum alloy.

Examples 2-41

Examples 2-41 are used to describe the aluminum alloy and the preparation method thereof in the present disclosure, including most of the steps in Example 1, and the difference is as follows:

Using the compositions of the aluminum alloy shown in Examples 2-41 in Table 1, the required weight of intermediate alloys or metal elements was calculated based on the weight of the components of the aluminum alloy, and the intermediate alloys or metal elements were melted and mixed into an aluminum alloy ingot. The aluminum alloy ingot was naturally aged for 7 d to obtain an aluminum alloy.

Comparative Example 1

This comparative example is used to comparatively describe the aluminum alloy and the preparation method thereof in the present disclosure, including the following steps:

As shown in Table 1, the components of the aluminum alloy in percentage by weight include: 10% of Si, 2.5% of Cu, 1.5% of Zn, 0.7% of Mn, 0.5% of Mg, 0.015% of Cr, 0.015% of Sr, 0.09% of Ti, 0.01% of B, 0.2% of Fe, 0.013% of Ga, 0.013% of Sn, and 0.15% of P. The required weight of intermediate alloys or metal elements was calculated based on the weight of the foregoing components of the aluminum alloy, and the intermediate alloys or metal elements were melted and mixed into an aluminum alloy ingot. The aluminum alloy ingot was naturally aged for 7 d to obtain an aluminum alloy.

Comparative Examples 2-23

Comparative Examples 2-23 are used to describe the aluminum alloy and the preparation method thereof in the present disclosure, including most of the steps in Example 1, and the difference is as follows:

Using the compositions of the aluminum alloy shown in Comparative Examples 2-23 in Table 1, the required weight of intermediate alloys or metal elements was calculated based on the weight of the components of the aluminum alloy, and the intermediate alloys or metal elements were melted and mixed into an aluminum alloy ingot. The aluminum alloy ingot was naturally aged for 7 d to obtain an aluminum alloy.

Performance Test

1. The metallographic structure of the aluminum alloy prepared in Example 1 was observed to obtain a metallographic image shown in FIG. 1.

In the figure, the white area is α-A1, which is spherical or rod-shaped and about 10 μm in size;

the dark gray area is primary Si, which is randomly distributed between the α-A1 grain boundaries;

the light gray area is $Al_2Cu$, which is distributed between the α-A1 grain boundaries and is irregularly bone-shaped; and the densely distributed areas in the form of particles and ovals are eutectic Si and strengthening phases, which are mainly distributed around the α-A1 grains.

Figure 2:
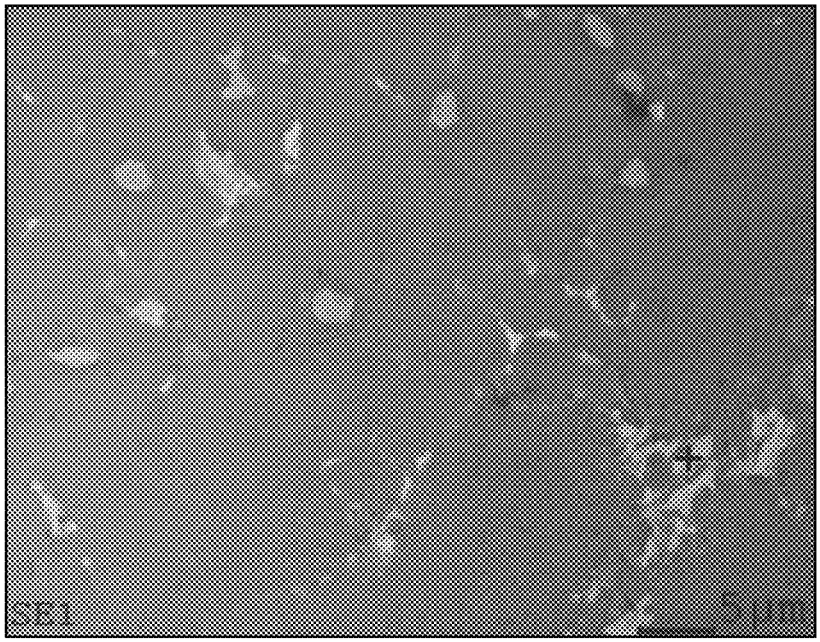
FIG. 2 is an SEM image of an aluminum alloy provided in Example 1 of the present disclosure.
Figure 3:
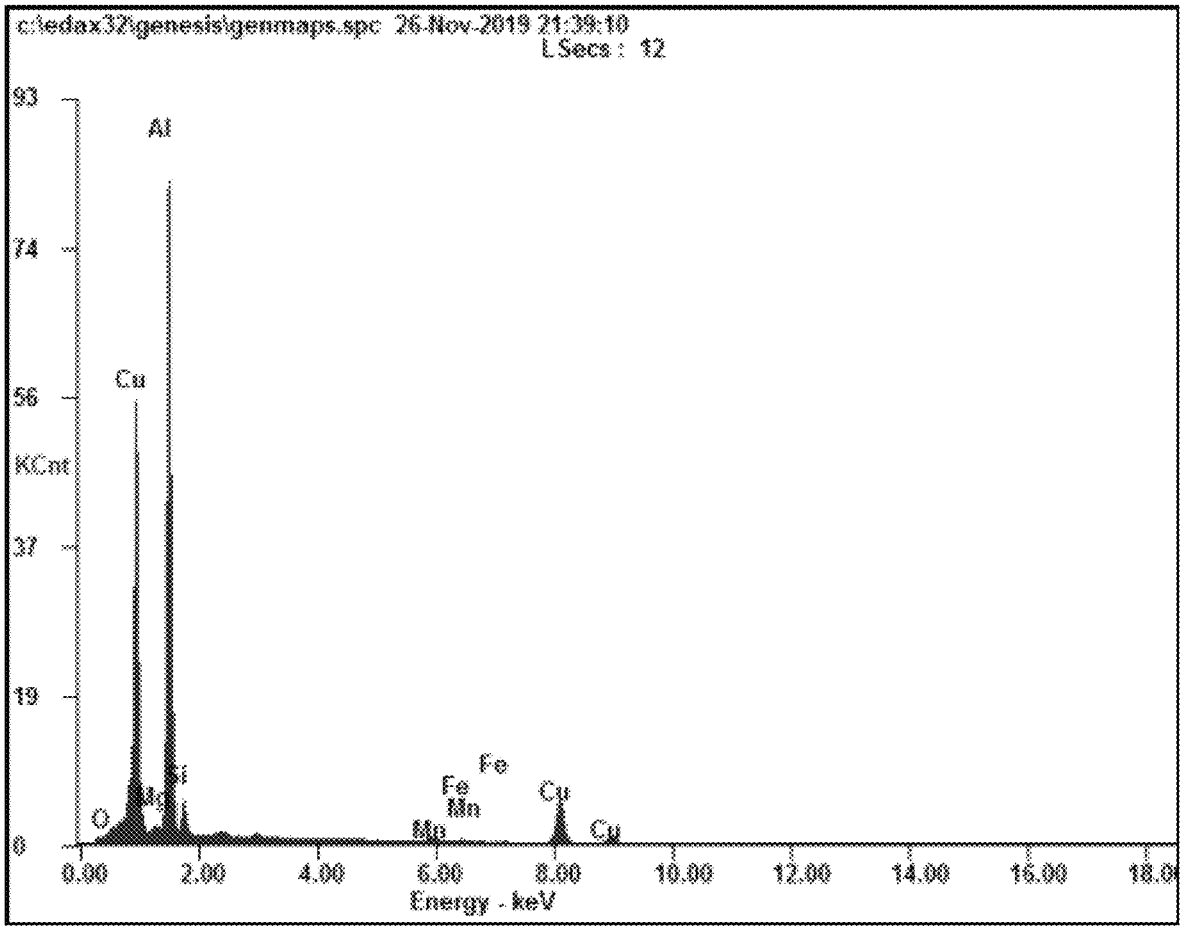
FIG. 3 is an EDS spectrum of the area marked with the cross in FIG. 2.
Figure 4:
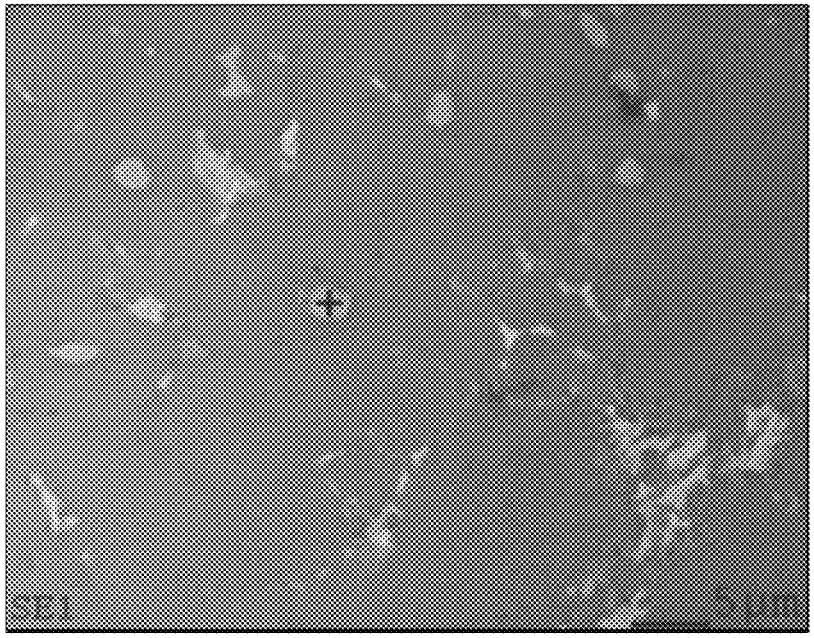
FIG. 4 is an SEM image of an aluminum alloy provided in Example 1 of the present disclosure.
Figure 6:
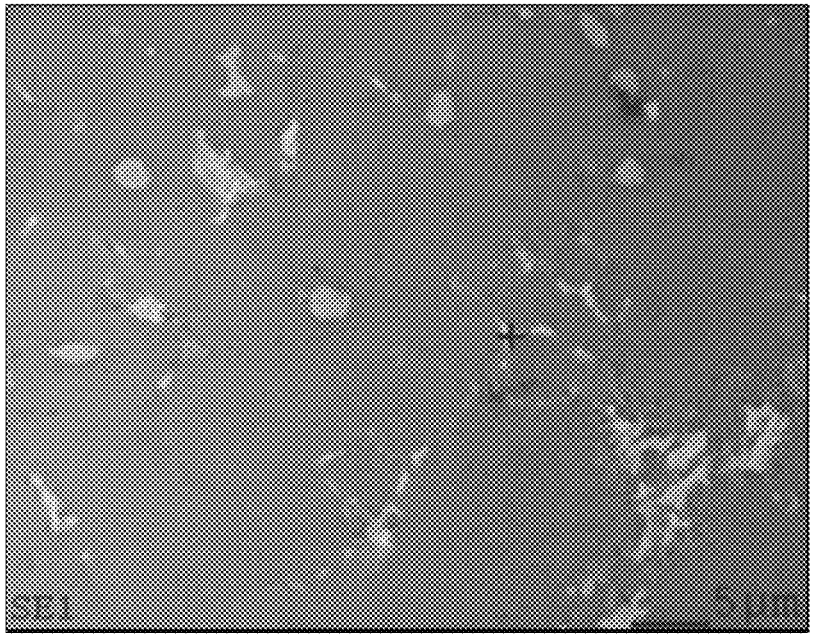
FIG. 6 is an SEM image of an aluminum alloy provided in Example 1 of the present disclosure.

The aluminum alloy prepared in Example 1 was imaged by using a scanning electron microscope (SEM) to obtain SEM images shown in FIG. 2, FIG. 4, and FIG. 6. The area marked with the cross in FIG. 2 was subjected to EDS detection to obtain an EDS spectrum shown in FIG. 3. The EDS spectrum was analyzed to obtain the composition of the area marked with the cross in FIG. 2, as shown in Table 2.

TABLE 2

| Element | wt % | at % |
|---|---|---|
| O | 00.80 | 01.76 |
| Mg | 00.69 | 00.99 |
| Al | 53.54 | 69.69 |
| Si | 03.65 | 04.57 |

TABLE 2-continued

| Element | wt % | at % |
|---|---|---|
| Mn | 01.07 | 00.69 |
| Fe | 00.62 | 00.39 |
| Cu | 39.63 | 21.91 |

It can be learned from Table 2 that this area is a $CuAl_2$ phase, which is irregularly bone-shaped, is light pink without erosion, and is one of the main strengthening phases in the alloy. Because this phase is excessively small, and the minimum test range of the test point is 1 $\mu m^2$, the obtained composition is slightly deviated.

Figure 5:
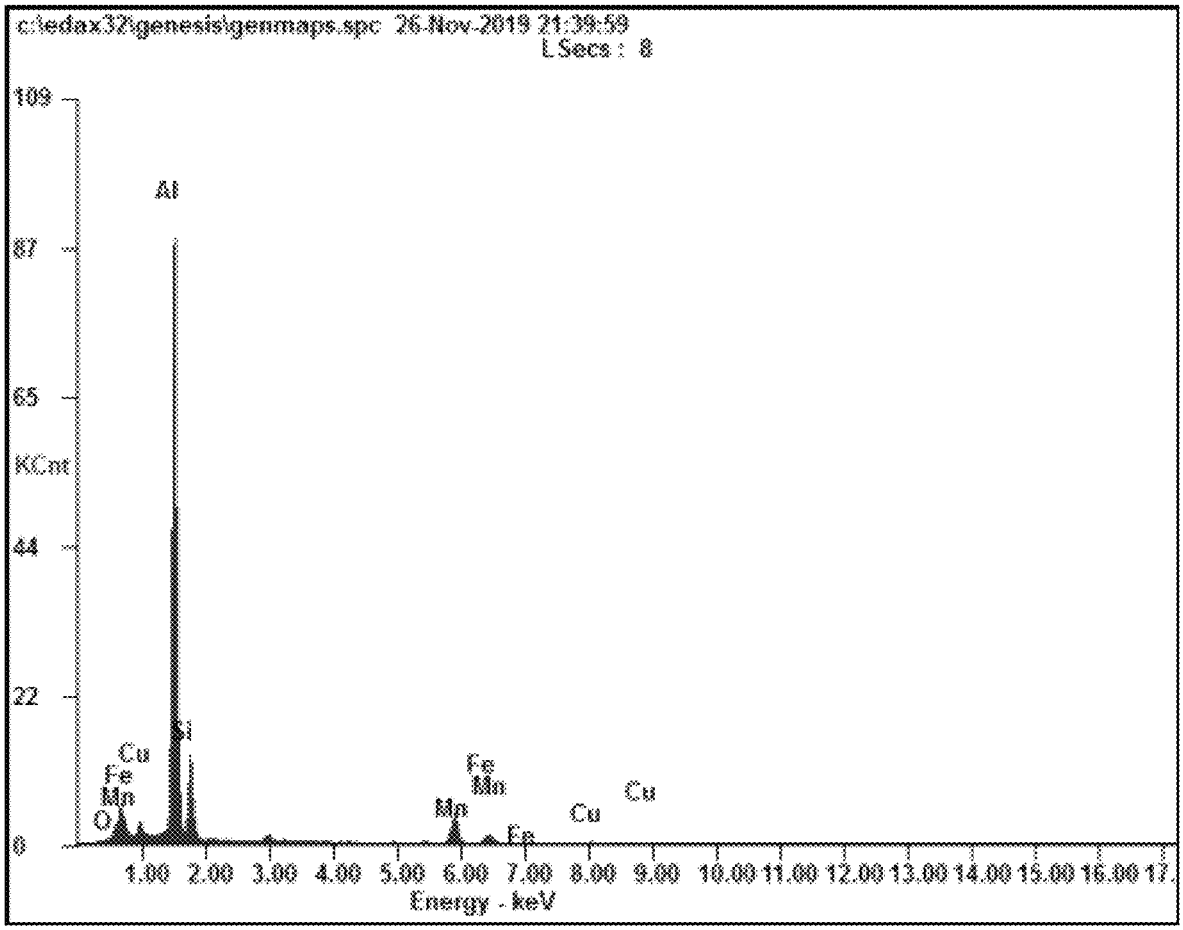
FIG. 5 is an EDS spectrum of the area marked with the cross in FIG. 4.

The area marked with the cross in FIG. 4 was subjected to EDS detection to obtain an EDS spectrum shown in FIG. 5. The EDS spectrum was analyzed to obtain the composition of the area marked with the cross in FIG. 4, as shown in Table 3.

TABLE 3

| Element | wt % | at % |
|---|---|---|
| O | 00.02 | 00.05 |
| Al | 62.01 | 71.21 |
| Si | 14.09 | 15.54 |
| Mn | 16.66 | 09.40 |
| Fe | 04.31 | 02.39 |
| Cu | 02.90 | 01.41 |

It can be learned from Table 3 that this area is an a (AlMnSi or $Al_{12}MnSi$) phase, which is mostly irregular in shape and is bright gray without erosion, and Fe, Mn, Cu, and Cr may be substituted for each other.

Figure 7:
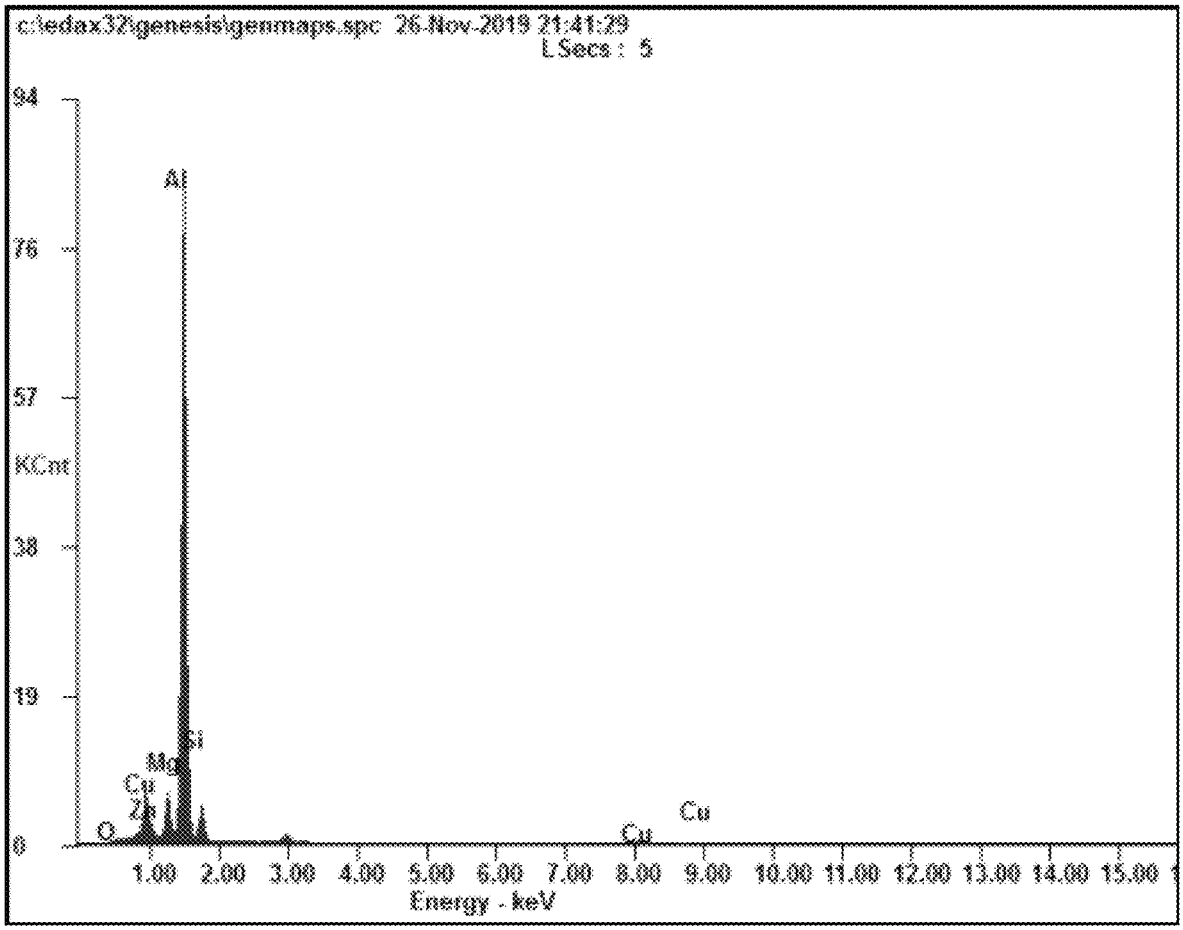
FIG. 7 is an EDS spectrum of the area marked with the cross in FIG. 6.

The area marked with the cross in FIG. 6 was subjected to EDS detection to obtain an EDS spectrum shown in FIG. 7. The EDS spectrum was analyzed to obtain the composition of the area marked with the cross in FIG. 6, as shown in Table 4.

TABLE 4

| Element | wt % | at % |
|---|---|---|
| O | 00.56 | 00.99 |
| Zn | 01.56 | 00.68 |
| Mg | 04.71 | 05.51 |
| Al | 77.42 | 81.50 |
| Si | 07.61 | 07.69 |
| Cu | 08.15 | 03.64 |

It can be learned from Table 4 that this area is a $W(Al_xCu_4Mg_5Si_4)$ phase, which is a quaternary phase and is a bone-shaped or ice-shaped dense eutectic. Because this phase is excessively small, and the minimum test range of the test point is 1 $\mu m^2$, the obtained composition is slightly deviated.

Figure 8:
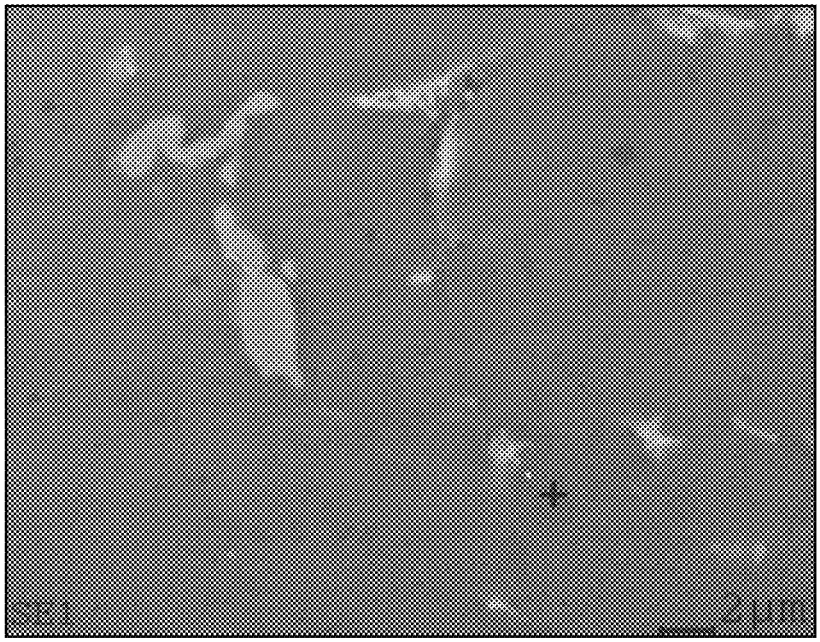
FIG. 8 is an SEM image of an aluminum alloy provided in Example 2 of the present disclosure.
Figure 9:
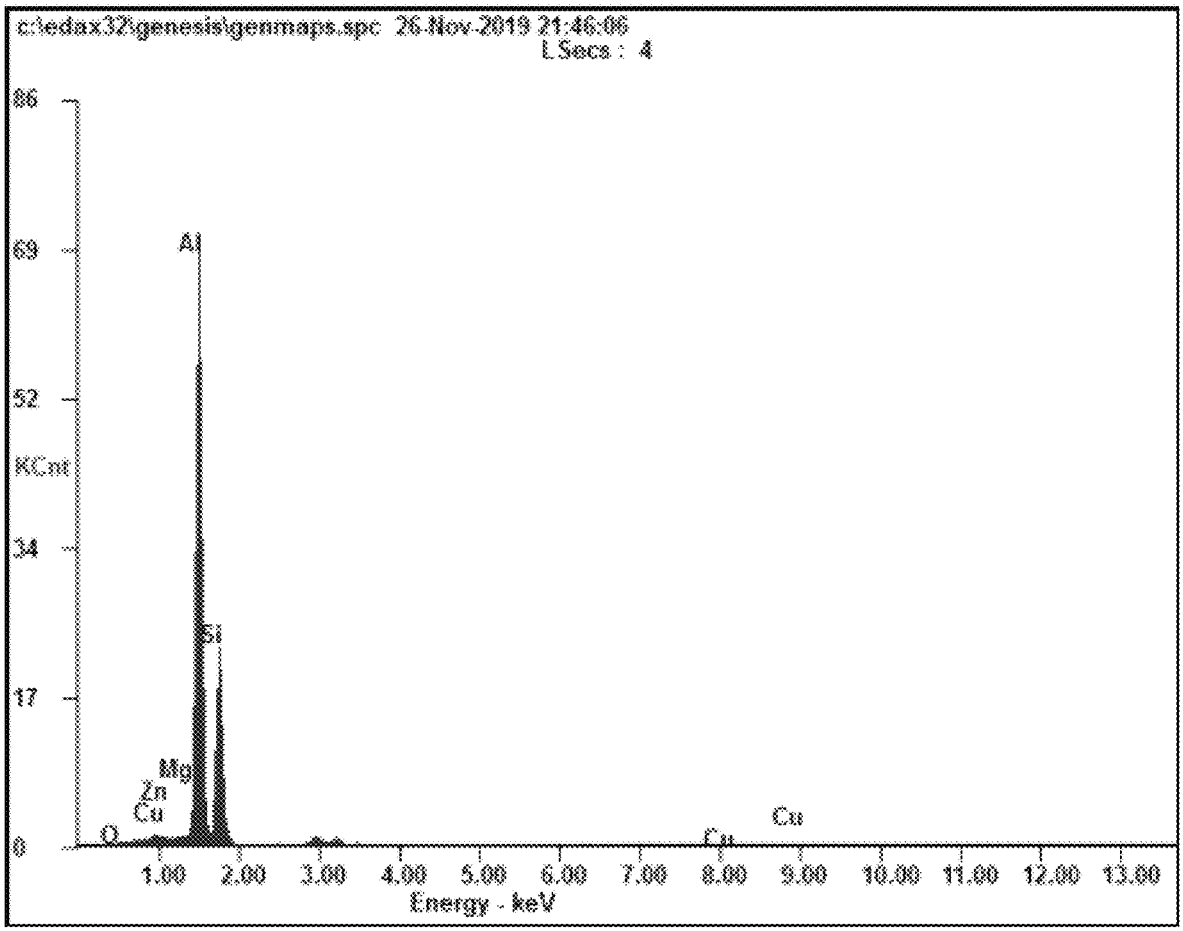
FIG. 9 is an EDS spectrum of the area marked with the cross in FIG. 8.

The aluminum alloy prepared in Example 2 was imaged by using a scanning electron microscope (SEM) to obtain an SEM image shown in FIG. 8. The area marked with the cross in FIG. 8 was subjected to EDS detection to obtain an EDS spectrum shown in FIG. 9. The EDS spectrum was analyzed to obtain the composition of the area marked with the cross in FIG. 8, as shown in Table 5.

TABLE 5

| Element | wt % | at % |
|---|---|---|
| O | 00.25 | 00.43 |
| Zn | 00.39 | 00.16 |
| Mg | 00.31 | 00.35 |
| Al | 60.50 | 61.71 |
| Si | 37.75 | 36.99 |
| Cu | 00.81 | 00.35 |

It can be learned from Table 5 that this area is eutectic Si, which is mostly granular and uniformly dispersed around α-Al, and is one of the main strengthening phases in the alloy.

2. The aluminum alloys prepared in Examples 1-41 and Comparative Examples 1-23 were subjected to the following performance tests:

Tensile Test:

The yield strength, tensile strength, and elongation were tested according to GBT 228.1-2010 Metallic Materials Tensile Testing Part 1: Room Temperature Test Methods.

Comparative Analysis of Three-Point Bending Test:

The aluminum alloy was die-cast to form a mobile phone mid plate test piece with a size determined before testing. Two horizontal and parallel steel support rollers with a diameter of 6 mm were provided and adjusted to a distance between the axes of 110 mm. The test piece faced up was placed on the two support rollers. A steel indenter with a diameter of 6 mm was provided above the test piece. The center of the test piece was coincident with the position of the indenter. The force was reset to zero before the indenter contacted the test piece. The indenter moved downward at a speed of 5 mm/min. When the force of the indenter on the test piece was 3 N, the force and displacement were reset to zero, and the indenter continued to move at the same speed until the test piece broke. The maximum breaking force and breaking deflection were recorded.

Fluidity Test:

Test condition: Mosquito coil mold, die casting under atmospheric pressure

Test method: Under the same molding conditions, the length of test pieces of a to-be-tested material and a standard material ADC12 after die casting was compared, and the fluidity was calculated by dividing the length of the to-be-tested material by the length of the standard material, to evaluate the flow molding performance of the material.

Thermal Conductivity Test:

A thermally conductive ingot wafer of ϕ 12.7×3 mm was prepared as a to-be-tested piece, and graphite was evenly sprayed on both sides of the to-be-tested piece to form a coating. The coated piece was tested by using a laser thermal conductivity instrument. The laser thermal conductivity test was carried out in accordance with ASTM E1461 Standard Test Method for Thermal Diffusivity by the Flash Method.

The test results are shown in Table 6.

TABLE 6

| | Yield strength (MPa) | Tensile strength (MPa) | Elongation | Maximum breaking force | Breaking deflection | Fluidity in mosquito coil mold | Thermal conductivity of ingot W/(m · k) |
|---|---|---|---|---|---|---|---|
| Example 1 | 238 | 385 | 4.8 | 408 | 6.05 | 100 | 138 |
| Example 2 | 232 | 382 | 5 | 405 | 6.23 | 96 | 140 |
| Example 3 | 240 | 392 | 4.6 | 417 | 5.81 | 101 | 135 |
| Example 4 | 230 | 383 | 5.2 | 406 | 6.45 | 100 | 138 |
| Example 5 | 245 | 398 | 4.3 | 421 | 5.55 | 99 | 135 |
| Example 6 | 239 | 386 | 4.8 | 409 | 6.02 | 101 | 139 |
| Example 7 | 241 | 388 | 4.7 | 411 | 5.91 | 99 | 134 |
| Example 8 | 234 | 383 | 5 | 404 | 6.25 | 99 | 141 |
| Example 9 | 240 | 391 | 4.7 | 414 | 5.95 | 101 | 135 |
| Example 10 | 230 | 380 | 6 | 403 | 7.25 | 100 | 141 |
| Example 11 | 246 | 388 | 4 | 412 | 5.19 | 100 | 133 |
| Example 12 | 231 | 382 | 5 | 405 | 6.25 | 100 | 138 |
| Example 13 | 241 | 390 | 4.3 | 413 | 5.5 | 100 | 137 |
| Example 14 | 232 | 382 | 5.2 | 405 | 6.45 | 100 | 139 |
| Example 15 | 245 | 393 | 4 | 420 | 5.28 | 100 | 137 |
| Example 16 | 236 | 384 | 5.1 | 405 | 6.35 | 100 | 139 |
| Example 17 | 242 | 393 | 4.6 | 416 | 5.83 | 100 | 138 |
| Example 18 | 236 | 381 | 4.9 | 404 | 6.15 | 100 | 140 |
| Example 19 | 240 | 388 | 5.2 | 410 | 6.43 | 100 | 141 |
| Example 20 | 235 | 383 | 5.5 | 406 | 6.72 | 98 | 139 |
| Example 21 | 244 | 394 | 4.1 | 417 | 5.35 | 101 | 137 |
| Example 22 | 233 | 382 | 5.1 | 405 | 6.35 | 100 | 138 |
| Example 23 | 241 | 390 | 4.7 | 410 | 5.93 | 100 | 138 |
| Example 24 | 231 | 380 | 5 | 403 | 6.25 | 100 | 139 |
| Example 25 | 237 | 389 | 4.4 | 412 | 5.6 | 100 | 137 |
| Example 26 | 230 | 380 | 6 | 402 | 7.25 | 95 | 137 |
| Example 27 | 261 | 420 | 3.3 | 443 | 4.59 | 96 | 134 |
| Example 28 | 238 | 388 | 3.5 | 409 | 4.75 | 98 | 131 |
| Example 29 | 249 | 389 | 4 | 412 | 5.27 | 99 | 131 |
| Example 30 | 252 | 396 | 3.9 | 420 | 5.15 | 100 | 130 |
| Example 31 | 255 | 392 | 3.8 | 415 | 5.01 | 100 | 134 |
| Example 32 | 256 | 399 | 3.4 | 422 | 4.65 | 100 | 134 |
| Example 33 | 259 | 397 | 3.2 | 422 | 4.44 | 99 | 134 |
| Example 34 | 241 | 389 | 3.9 | 412 | 5.15 | 100 | 132 |
| Example 35 | 244 | 388 | 3.2 | 411 | 4.49 | 100 | 133 |
| Example 36 | 233 | 381 | 4.2 | 404 | 5.45 | 100 | 121 |
| Example 37 | 240 | 393 | 3.5 | 418 | 4.75 | 100 | 125 |
| Example 38 | 242 | 380 | 3 | 403 | 4.22 | 98 | 129 |
| Example 39 | 252 | 396 | 3.1 | 419 | 4.33 | 100 | 128 |

TABLE 6-continued

| | Yield strength (MPa) | Tensile strength (MPa) | Elongation | Maximum breaking force | Breaking deflection | Fluidity in mosquito coil mold | Thermal conductivity of ingot W/(m · k) |
|---|---|---|---|---|---|---|---|
| Example 40 | 253 | 396 | 3 | 418 | 4.4 | 100 | 128 |
| Example 41 | 260 | 400 | 3 | 423 | 4.22 | 102 | 127 |
| Comparative Example 1 | 241 | 362 | 2.3 | 385 | 3.72 | 98 | 121 |
| Comparative Example 2 | 220 | 353 | 6.2 | 376 | 7.11 | 90 | 130 |
| Comparative Example 3 | 241 | 370 | 2.1 | 393 | 3 | 102 | 120 |
| Comparative Example 4 | 213 | 341 | 5.9 | 364 | 6.88 | 98 | 131 |
| Comparative Example 5 | 280 | 399 | 2.2 | 424 | 3.02 | 93 | 123 |
| Comparative Example 6 | 212 | 381 | 3 | 404 | 5.82 | 99 | 131 |
| Comparative Example 7 | 279 | 365 | 2.3 | 378 | 3.81 | 94 | 118 |
| Comparative Example 8 | 229 | 361 | 5.8 | 384 | 6.74 | 100 | 130 |
| Comparative Example 9 | 249 | 399 | 2.4 | 421 | 3.66 | 98 | 118 |
| Comparative Example 10 | 219 | 351 | 7 | 374 | 7.9 | 99 | 131 |
| Comparative Example 11 | 193 | 379 | 4.1 | 402 | 5.21 | 100 | 131 |
| Comparative Example 12 | 274 | 388 | 2.3 | 411 | 3.2 | 100 | 125 |
| Comparative Example 13 | 218 | 362 | 5.8 | 385 | 6.7 | 100 | 129 |
| Comparative Example 14 | 242 | 399 | 2.5 | 412 | 3.71 | 100 | 128 |
| Comparative Example 15 | 215 | 375 | 5 | 398 | 5.99 | 100 | 125 |
| Comparative Example 16 | 277 | 399 | 1.9 | 422 | 3.83 | 100 | 118 |
| Comparative Example 17 | 209 | 373 | 3.2 | 396 | 4.12 | 100 | 125 |
| Comparative Example 18 | 289 | 367 | 2.3 | 388 | 3.8 | 100 | 126 |
| Comparative Example 19 | 240 | 333 | 1.5 | 356 | 2.4 | 98 | 121 |
| Comparative Example 20 | 213 | 332 | 5 | 355 | 3.88 | 100 | 131 |
| Comparative Example 21 | 289 | 393 | 2 | 416 | 3.8 | 100 | 128 |
| Comparative Example 22 | 219 | 379 | 5.2 | 402 | 6.15 | 100 | 131 |
| Comparative Example 23 | 250 | 339 | 2.6 | 362 | 3.8 | 100 | 127 |

It can be learned by comparing the test results of Examples 1-41 with the test results of Comparative Examples 1-23 that, compared with aluminum alloys without the element range provided in the present disclosure, the aluminum alloy provided in the present disclosure has good mechanical strength, may meet the requirements of the die-casting process, and has good thermal conductivity, elongation, and die-casting formability.

The implementations of the present disclosure are described in detail above, but the present disclosure is not limited to the details in the foregoing implementations. Various simple variations may be made to the technical solutions of the present disclosure within the scope of the technical idea of the present disclosure, and such simple variations shall all fall within the protection scope of the present disclosure.

It should be further noted that the technical features described in the foregoing implementations may be combined in any suitable manner without contradiction. To avoid unnecessary repetition, various possible combinations are not further described in the present disclosure.

In addition, the various embodiments of the present disclosure may be combined without departing from the idea of the present disclosure, and such combinations shall also fall within the scope of the present disclosure.

In the descriptions of this specification, descriptions using reference terms "an embodiment", "some embodiments", "an example", "a specific example", or "some examples" mean that specific characteristics, structures, materials, or features described with reference to the embodiment or example are included in at least one embodiment or example of the present disclosure. In this specification, schematic representations of the foregoing terms are not necessarily directed to the same embodiment or example. Moreover, the specific features, structures, materials, or characteristics described may be combined in any one or more embodiments or examples in a suitable manner. In addition, different embodiments or examples described in this specification, as well as features of different embodiments or examples, may be integrated and combined by a person skilled in the art without contradicting each other.

Although the embodiments of the present disclosure have been shown and described above, it can be understood that, the foregoing embodiments are exemplary and cannot be understood as limitation to the present disclosure. A person of ordinary skill in the art can make changes, modifications, replacements, or variations to the foregoing embodiments within the scope of the present disclosure.

What is claimed is:

1. An aluminum alloy, based on the total weight of the aluminum alloy, the aluminum alloy consisting of:

8-11% of Si;
2-4% of Cu;
0.6-4% of Zn;
0.65-1.1% of Mn;
0.35-0.65% of Mg;
0.001-0.05% of Cr;
0.01-0.03% of Sr;
0.08-0.12% of Ti;
0.008-0.02% of B;
0.1-0.3% of Fe;
0.01-0.02% of Ga;
0.008-0.015% of Sn; and
the balance of Al and less than 0.1% of other elements.

2. The aluminum alloy according to claim 1, based on the total weight of the aluminum alloy, the aluminum alloy consisting of:

9-11% of Si;
2-3% of Cu;
0.6-2% of Zn;
0.65-0.8% of Mn;
0.35-0.65% of Mg;
0.001-0.02% of Cr;
0.01-0.02% of Sr;
0.08-0.1% of Ti;
0.008-0.01% of B;
0.1-0.3% of Fe;
0.01-0.02% of Ga;
0.008-0.015% of Sn; and
the balance of Al and less than 0.1% of other elements, each of the other elements being less than 0.01%.

3. The aluminum alloy according to claim 1, wherein based on the total weight of the aluminum alloy, a content of P in the aluminum alloy is less than 0.001%.

4. The aluminum alloy according to claim 1, wherein in the aluminum alloy, a weight ratio of Ti to B is (4-10):1.

5. The aluminum alloy according to claim 1, wherein in the aluminum alloy, a content of Ga in percentage by weight is greater than a content of B in percentage by weight.

6. The aluminum alloy according to claim 1, wherein in the aluminum alloy, a weight ratio of Mn to Mg is (1-2.5):1.

7. The aluminum alloy according to claim 1, wherein in the aluminum alloy, a weight ratio of Ga to Sn is (0.8-1.5):1.

8. The aluminum alloy according to claim 1, wherein in the aluminum alloy, Zn, Mn, and Mg satisfy the following relationship in weight:

$$-3.979+4.9\ Mn+3.991\ Mg \leq Zn \leq 8.598-5.047\ Mn-3.762\ Mg.$$

9. The aluminum alloy according to claim 1, wherein a yield strength of the aluminum alloy is not less than 230 MPa, a tensile strength of the aluminum alloy is not less than 380 MPa, an elongation of the aluminum alloy is not less than 3%, and a thermal conductivity of the aluminum alloy is not less than 120 W/(k·m).

10. The aluminum alloy according to claim 2, wherein based on the total weight of the aluminum alloy, a content of P in the aluminum alloy is less than 0.001%.

11. The aluminum alloy according to claim 10, wherein in the aluminum alloy, a weight ratio of Ti to B is (4-10):1.

12. The aluminum alloy according to claim 11, wherein in the aluminum alloy, a content of Ga in percentage by weight is greater than a content of B in percentage by weight.

13. The aluminum alloy according to claim 12, wherein in the aluminum alloy, a weight ratio of Mn to Mg is (1-2.5):1.

14. The aluminum alloy according to claim 13, wherein in the aluminum alloy, a weight ratio of Ga to Sn is (0.8-1.5):1.

15. The aluminum alloy according to claim 14, wherein in the aluminum alloy, Zn, Mn, and Mg satisfy the following relationship in weight:

$$-3.979+4.9\ Mn+3.991\ Mg \leq Zn \leq 8.598-5.047\ Mn-3.762\ Mg.$$

16. The aluminum alloy according to claim 15, wherein a yield strength of the aluminum alloy is not less than 230 MPa, a tensile strength of the aluminum alloy is not less than 380 MPa, an elongation of the aluminum alloy is not less than 3%, and a thermal conductivity of the aluminum alloy is not less than 120 W/(k·m).

17. A mobile phone, comprising the aluminum alloy according to claim 1.

* * * * *